United States Patent [19]

Barrett, Jr. et al.

[11] 3,953,353

[45] Apr. 27, 1976

[54] LAUNDERING PRE-SPOTTER AND METHOD OF PRODUCTION

[75] Inventors: John H. Barrett, Jr., La Mirada; Brian P. Flynn, Long Beach, both of Calif.

[73] Assignee: Purex Corporation, Lakewood, Calif.

[22] Filed: Nov. 8, 1974

[21] Appl. No.: 521,969

[52] U.S. Cl. ..... 252/174; 252/90; 252/134; 252/DIG. 12

[51] Int. Cl.[2] ..... C11D 17/00

[58] Field of Search ..... 252/174, 134, 90, DIG. 12

[56] References Cited

UNITED STATES PATENTS

| | | | |
|---|---|---|---|
| 2,393,865 | 1/1946 | Wassell | 252/105 |
| 3,178,371 | 4/1965 | Friedenberg | 252/153 |
| 3,798,181 | 3/1974 | Vazquez | 252/174 |

*Primary Examiner*—William E. Schulz
*Attorney, Agent, or Firm*—White and Haefliger

[57] ABSTRACT

A solid product for rub-on application to stains and soil deposits on fabric preparatory to laundering, comprising blended water soluble non-ionic detergent and stable laundry enzyme uniformly dispersed therein, and the method of manufacturing the product.

17 Claims, No Drawings

LAUNDERING PRE-SPOTTER AND METHOD OF PRODUCTION

BACKGROUND OF THE INVENTION

Laundry prespotters have long been known and used to treat fabric stains which resist the usual washing processes. The advent and increasing use of hydrophobic synthetic fibers in place of cotton has created a need for improved stain treatments to combat the affinity of such fibers for greasy soils as well as other wash resistant soils. The application of permanent press finishes to cotton and cotton blends also has accentuated the need for effective prespotters designed for removal of a multiplicity of grease and food based stains.

Prior art prespotters in the form of liquids, powders, aerosols and sticks are known.

Liquids containing specific chemical reagents acting to decolorize or remove certain stains by means of chemical reaction on the stain are known (e.g., the familiar two solution "ink eradicator"), as are solid sticks containing specific chemicals or solvents to react with or dissolve specific stains. None of these stain removers are effective against a wide spectrum of stains.

Liquid laundry detergents have been recommended for direct application to heavily soiled areas. Laundry bar soaps and dry powdered detergents have been similarly recommended for application to moistened soiled fabrics. Dry products, some containing enzymes, having been marketed for use with water to form a presoak solution in which heavily stained articles are immersed for a time prior to laundering. Each of the foregoing suffer from the disadvantage of inconvenience in use, need for dilution with water with accompanying loss of effectiveness, tendency to spill, tendency to contact the skin, danger of accidental ingestion or failure to affect a broad spectrum of stains.

Aerosol prespotters, some containing enzymes, are known, but these suffer the disadvantages common to aerosols such as flammability, inhalation danger, depletion of atmospheric ozone, and the problem of safe disposal of empty containers.

Liquid prespotters, some containing enzymes, are known but these share with the other liquids mentioned above inconvenience in use, tendency to spill, and danger of accidental ingestion.

DESCRIPTION AND EXAMPLES

The object of our invention is to provide a prespotter in solid form of nonionic detergent and enzyme composition which is free of the above cited disadvantages associated with prior art compositions; which is particularly well suited for use on all fabrics — both traditional and modern, both sturdy and delicate; which applies directly on a stain a maximum concentration of effective soil removing agents, and which is effective on a broad spectrum of soils. Accordingly, we have provided a prespotter which can be molded in the form of a stick with structural rigidity sufficient to permit forceful application to a soiled fabric, enough softness to permit substantial quantities to become transferred to the soiled fabric as a consequence of being rubbed against the fabric, sufficient plasticity to prevent cracking or crumbling in use, and yet able to withstand prolonged storage at elevated temperatures up to about 125° F.

No single nonionic detergent is known which embodies all of the desired features. Those which are solid at room temperatures are either too hard and brittle, or are not sufficiently resistant to high temperatures often encountered in warehouse storage.

We have discovered that suitable physical characteristics may be obtained with certain substantially anhydrous mixtures of materials yielding solid masses having a combination of hardness and plasticity such that the ASTM Penetrometer hardness, using a standard needle with a 50 gram load, is between 4.5 and 10.5 mm and preferably between 6.5 and 8.5 mm; together with a melting point of 125° to 140° F and preferably between 128° to 134° F when measured by the method of Class II materials of the Pharmacopeia of the United States, Revision XVIII. The expression "essentially anhydrous" is used in the product description and definition in recognition that the product may not be strictly anhydrous because of minor accummulations of moisture in the mixture ingredients during storage or as received from the suppliers. The product moisture content will not be substantial and usually below a maximum of 2%. We have found these substantially anhydrous mixtures to be effective vehicles for applying enzymes to stains while affording excellent long term storage stability with respect to enzyme potency.

Our prespotter stick is typically composed of an intimate mixture of:

A. 5–40% waxy solid, preferably water soluble nonionic which imparts body and harness, B. 10–60% solid nonionic detergents having effective surfactant and stain removing properties, C. 10–75% liquid nonionics serving to plasticize the mixture and which preferably also act as effective surfactants, and D. 0.01–10% laundry enzyme. Examples of these typical compositions as to their A, B, and C components are:

1. A: 20% Carbowax 4000 (Union Carbide's polyethylene glycol 4000 with mol. wt. 3000–3700)

B: 30% Pluronic F-68 (BASF Wyandotte's polyethylene oxide polypropylene propylene glycol containing about 80% ethylene oxide on a hydrophobe of about 1750 mol. wt.)

C. 50% Igepal CO-630 (GAF's polyethoxylated nonyl phenol containing an average of 9.5 moles of ethylene oxide).

2. 20% Carbowax 6000 (Union Carbide's polyethylene glycol 6000 with mol. wt. of 6000–7500)

B: 30% Plurafac A-38 (BASF Wyandotte's polyethoxylated fatty alcohol, believed to contain about 12 moles ethylene oxide)

C: 50% Igepal CO-630

3. A: 10% Carbowax 6000

B: 25% T-Det N-30 (Thompson-Hayward Chemical's polyethoxylated nonyl phenol containing an average of 30 moles of ethylene oxide)

C: 65% Igepal CO-630

4. A: 20% Carbowax 6000

B: 30% Neodol 25–12 (Shell Chemical's polyethoxylated $C_{12}$–$C_{15}$ primary linear alcohol with 12 moles of ethylene oxide) and 30% Pluronic EA-7135 (BASF Wyandotte's polyethoxylated fatty alcohol believed to contain about 100 moles of ethylene oxide).

C: 20% Igepal CO-630

5. A: 25% Carbowax 6000

B: 50% Neodol 25–12

C: 25% Neodol 23–6.5 (Shell Chemical's polyethoxylated $C_{12}$–$C_{13}$ primary linear alcohols with an average of 6.5 moles of ethylene oxide).

The above examples provide a solid composition having nearly optimum strength, plasticity, hardness and resistance to high storage temperatures while providing high concentrations of effective surfactants. We have found that useful solid compositions can be achieved without using any waxy component (A) by combining from 40 to 90% of a solid nonionic detergent (B) with from 10 to 60% of a liquid nonionic (C). Examples of such compositions are:

6. B: 40% Pluronic F-68
   C: 60% Igepal CO-630
7. B: 50% Pluronic EA-7135
   C: 50% Carbowax 400 (Union Carbide's polyethylene glycol 400 with a mol. wt. of 380–420.)

The compositions of examples 6 and 7 melt about 120° F, in contrast to examples 1–5 which melt at about 130° F. The last two examples are therefore, less resistant to high storage temperatures and correspondingly less desirable.

We have further found that useful solid compositions can be achieved without use of solid nonionic detergent (B) by combining from 40 to 70% of a waxy component (A) with from 30 to 60% of a liquid nonionic detergent (C). An example of such a composition is:

8. A. 60% Carbowax 4000
   C: 40% Igepal CO-630

The composition of example 8 has desirable physical characteristics, but imparts to treated stains less active surfactant than any of the more preferred compositions 1–5.

Dry powdered, granulated or prilled enzymes may be incorporated in any of the above compositions to produce a final composition containing from about 0.01% to 10.0% of enzyme. An example of such a composition is:

9. A: 10% Carbowax 6000
   B: 25% T-DET N-30
   C: 64.5% Igepal CO-630
   D: 0.5% Esperase P.4.0 (Novo's prilled proteolytic enzyme—see below under "Enzymes")

The composition of example 9 has all of the aforementioned desirable attributes and in addition is highly effective in removing protein bound soils such as grass stains, as well as a wide spectrum of common stains such as grease, oil, lipstick, ball point pen ink, mascara, gravy, etc.

The above-named ingredients have substantially the following melting temperatures:

A: 100° to 200° F
B: 85° to 165° F
C: −40° to 80° F

SUITABLE RAW MATERIALS

A. Waxes: The following materials are suitable for use as the solid component A. These materials are all waxy in nature with melting points above about 100° F and preferably above 120° F and may be differentiated from the solid nonionic detergents described below in that they contain either hydrophobic or hydrophilic molecules, but not both. Suitable naturally occurring materials include vegetable waxes such as carnauba wax, candelilla wax, Japan wax, Ocuricury wax, sugarcane wax, palm wax, raffia wax, esparto wax, and Douglas fir bark wax; animal waxes such as beeswax, Chinese wax, shellac, and spermaceti; mineral waxes such as Montan wax, ozocerite and ceresin wax; and petroleum waxes such as refined paraffin and microcrystalline waxes.

Further suitable waxy materials are the synthetic waxes such as cetyl alcohol, stearyl alcohol or high molecular weight alcohols having 20 or more carbons; higher molecular weight saturated fatty acids with at least 12 carbons. More preferred by virtue of being water soluble or at least water dispersable are such synthetic waxes as esters of polyhydric alcohols including glycerol mono-, di-, and tristearates, ethylene glycol palmitate, ethylene glycol stearate, ethylene glycol dilaurate, ethylene glycol dimyristate, ethylene glycol dipalmitate, ethylene glycol distearate, propylene glycol palmitate, propylene glycol stearate, propylene glycol dilaurate, propylene glycol dipalmitate, propylene glycol distearate, methoxy polyethylene glycols with molecular weights from 1900 to 5,000, polyethylene glycols with molecular weights from 1300 to 20,000, and the like. Especially preferred are the polyethylene glycols with average molecular weights from about 3,000 to about 8,000. (Carbowax 4000 and Carbowax 6000, Union Carbide Co.).

B. Nonionic Detergents: Those suitable for use as the solid component B include all homologues of the classes described below whose melting point is about 80° F and preferably above 100° F. Those nonionic detergents suitable for use as liquid component C include all homologues of the classes described below with melting points below 80° F and preferably below about 60° F.

The term "nonionic detergent" as used herein may be defined to include all surface active agents possessing within their molecule both a hydrophilic group and hydrophobic group and which do not ionize in aqueous solution. Nonionic detergents are usually, but not necessarily, composed of the condensation products of ethylene oxide and propylene oxide with hydrophobic organic molecules and contain an average of 6 to 100 moles of alkylene oxide per mole of hydrophobe.

Suitable nonionic detergents are the polyoxyalkylene alkylphenols wherein the hydrophobic group contains a phenolic nucleus having a substituent alkyl group of at least 4 but preferably 8 to 12 carbon atoms and the hydrophilic portion is comprised of at least 3 but preferably 6 to 100 moles of ethylene oxide or propylene oxide per mole of alkylphenol. Exemplary of this type are ethoxylated nonylphenols with an average ethylene oxide content of 9.5 moles per mole of nonylphenol (Igepal CO-630 GAF) suitable for use as the liquid component "C" and those with an average ethylene oxide content of 30 moles per mole of nonylphenol (Igepal CO-880 GAF) suitable for use as the solid component B.

Also suitable nonionic detergents are the polyoxyalkylene alcohols wherein the hydrophobic group is derived from natural or synthetic primary or secondary straight chain fatty alcohols having about 8 to 22 carbon atoms and the hydrophilic group is composed of at least 3 but preferably 5 to 100 moles of ethylene oxide or propylene oxide.

Exemplary of this type of nonionic surfactant are secondary alcohol ethoxylates having 11 to 15 carbons in the secondary alcohol hydrophobe. Those with an average ethylene oxide content of 12 moles of ethylene oxide, (Tergitol 15-S-12 Union Carbide) are suitable for use as the solid "B" component while those containing 9 moles of ethylene oxide (Tergitol 15-S-9

Union Carbide) can be used as the liquid "C" component.

Other suitable nonionic detergents are the polyalkylene esters of the higher organic acids usually having 8 or more carbon atoms in the acid hydrophobe, and 10 or more moles of ethylene oxide as the hydrophilic group. Naturally occurring fatty acids of either animal or vegetable origin may be used, as well as tall-oil fatty acids or rosin acids. Synthetically derived fatty acids are also suitable as hydrophobes. Exemplary of this class are a polyoxyethylene stearate having 50 moles of ethylene oxide per mole of stearic acid (Myrj 53, Atlas Chemical Ind.), suitable for use as solid component "B"; and a polyoxyethylene condensate of naturally occurring coconut fatty acids having 5 moles of ethylene oxide per mole of coconut fatty acids (Ethofat C/15, Armak Co.), suitable for use as liquid component "C".

Still other suitable nonionic detergents are the polyalkylene alkylamines whose hydrophobic group is from a primary, secondary, or tertiary amine and whose ethylene oxide content is sufficiently high to impart both water solubility and nonionic characteristics in neutral and alkaline environments. Useful hydrophobic groups include the amines of fatty acids with 8 or more carbons or naturally occurring mixtures thereof, n-alkyl-1,3-propanediamine where the alkyl group is derived from fatty acids of 8 or more carbons, t-aliphatic alkylamines with 12 or more carbons, and dehydroabietylamines. Exemplary of this type of nonionic detergent are polyoxyethylene t-aliphatic amines wherein the aliphatic amine has from 12 to 14 carbons and the hydrophilic group an average of 15 moles of ethylene oxide per mole of amine (Priminox R-15, Rohm & Haas Co.), suitable for use as liquid component "C"; or wherein the aliphatic group contains from 18 to 22 carbons and there is an average of 25 moles of ethylene oxide per mole of amine (Priminox T-25, Rohm & Haas Co.), suitable for use as the solid component B.

Further suitable nonionic detergents are the polyalkylene alkylamides having a hydrophobic group derived from an amide of a fatty acid or ester, including napthenic esters and monoesters of dicarboxylic acids. Hydrophobic groups such as sulfonamides, imides, carbamnates, urea, guanidine and imidazoline are similarly useful. Examples of this class are the polyoxyethylene amide of hydrogenated tallow fatty acids having 60 moles of ethylene oxide per mole of hydrophobe (Ethomid HT-60, Armak Co.), suitable for use as the solid component B and the polyoxyethylene amide of oleic acid having 5 moles of ethylene oxide per mole of hydrophobe (Ethomid 0/15, Armak Co.), suitable for use as the liquid component C.

A further class of suitable nonionic detergents are the fatty acid esters of various polyols. These include the fatty acid esters of alkylene glycols, glycerols, polyglycerols, hexitols and sugars and their polyoxyethylene condensates. Exemplary of these nonionics are the polyoxyethylene sorbitan monostearate containing 20 moles of ethylene oxide per mole of hydrophobe (Tween 60, Atlas Chemical Div. I.C.I. America) suitable for use as the liquid component C and polyoxyethylene sorbitan tristearate containing 20 moles of ethylene oxide per mole of hydrophobe (Tween 65, Atlas Chemical Div. I.C.I. America), suitable for use as the solid component B.

An additional group of suitable nonionic detergents are the polyalkylene oxide block copolymers made by condensing alkylene oxides with a hydrophobic base itself obtained by condensing alkylene oxides with a reactive organic molecule. The hydrophobic base usually has a molecular weight of 500 to 2000 and the polyoxyalkylene hydrophilic portion may constitute from about 10 to about 95% of the total copolymer. The hydrophilic bases for these block copolymers are formed by the addition of one alkylene oxide to a mono or polyfunctional organic molecule having one or more reactive hydrogen atoms or hydroxyl groups, followed by the addition of more of the same alkylene oxide, a different alkylene oxide, or a fixed or varied ratio of two or more mixed alkylene oxides. Suitable starting mono or polyfunctional organic compounds include aliphatic and aromatic alcohols, acids, mercaptanes, amines, amides, glycols, glycerols and sugars. Alkylene oxides which may be used in the condensation to form the hydrophobe include propylene, butylene, styrene, cyclohexane, amylene. The hydrophilic polymer chain is usually polyoxyethylene but may also contain higher oxyalkylenes such as oxypropylene and oxybutylene. Exemplary of this group of nonionic detergents are polyoxyethylene polyoxypropylene glycols based on a hydrophobic polymer made by condensing propylene oxide with propylene glycol and having an average molecular weight of about 1750 and having an added hydrophilic group of polyoxyethylene. Such a polyol wherein the hydrophilic group comprises about 30% of the whole by weight (Pluronic L63, BASF Wyandotte Co.), is suitable for use as liquid component C and that wherein the hydrophilic group comprises about 80% of the whole by weight (Pluronic F-68, BSAF Wyandotte Co.) is suitable for use as the solid component B.

Further suitable miscellaneous types of nonionic detergents which may find use as either liquid component C or solid component B include fatty alkanolamides such as the monoethanolamides, diethanolamides and isopropanolamides wherein the acyl radical has about 10 to 14 carbons; amine oxides wherein at least one substituent on the nitrogen is of an alliphatic, aromatic, heterocyclic or alicyclic radical containing 6 or more carbons; sulfoxides; phosphine oxides; acetylenic glycols; and polyoxyethylene acetylenic glycols.

C. Other Nonionic Liquids: In addition to those nonionic detergents cited above which are suitable for use as liquid component C by reason of having a melting point below 80° F and preferably below about 60° F, we find other nonionic liquids are useful as liquid component C by virtue of serving as a plasticiser despite the lack of significant detergent function. We find the suitable plasticisers may be selected from the mono-, di-, and polyhydric alcohols, their alkyl or aryl ethers, their alkyl esters, or their alkoxy derivitives which are liquid above about 80° F. For example, ethylene glycol, glycerine, 1-hexanol, glyceryl triacetate or propylene glycol monomethyl ether may be used.

D. Enzymes: The enzymes suitable for use in this stick prespotter are generally well described by McCarty in U.S. Pat. No. 3,519,570. Applicable for our purposes are the hydrolase enzymes referred to in column 4 of the McCarty patent. Since McCarty, an improved physical form of enzyme has become commercially available and is now preferred over the dry powders he describes.

The presently preferred physical form of enzyme is known as "prilled enzymes." Prilled enzymes may consist of any of the above described commercially produced concentrated dry powdered laundry enzymes which have been rendered dust free and free flowing by having been encapsulated in spherical particles of an inert substance, usually a high melting water soluble wax such as one of those described above as suitable for use as the solid component A, or a high melting nonionic detergent such as one of those described above as suitable for use as solid component B. Especially preferred for manufacture of prilled enzymes intended for incorporation in detergent products are the highly ethoxylated fatty alcohols containing about 50 moles of ethylene oxide per mole of alcohol. Commercially available prilled enzymes are spherical particles usually between 100 and 1000 microns in diameter. A prilled enzyme product preferred for use in the compositions of this invention is Esperase P 4.0 manufactured by Novo Industri A/S of Copenhagen, Denmark. The primary enzyme component of Esperase P 4.0 is described by the manufacturer as being a subtilisin identical to that contained in Alcalase.

When Esperase P 4.0 is incorporated in the compositions of this invention by the methods herein described, its encapsulating agent melts, dissolves in and disperses throughout the molten mixture, thus releasing the finely divided powdered active enzyme which in turn, with mechanical agitation, becomes uniformly dispersed throughout.

PROCESS OF MANUFACTURE

We have discovered a process of manufacture by which the ingredients of our invention can be mixed and cast into a stick form that is homogenous in composition and free of crater-like surface depressions, while retaining the desired hardness, strength, plasticity and resistance to elevated storage temperatures.

The process is generally applicable to any of the contemplated compositions of our inventions with suitable adjustments in melting and casting temperatures to accommodate variations in melting range of the waxy component (A) and the solidification temperature of the final mass.

The essential features of our process are the melting together of the major components A, B and C, the addition of enzyme at a temperature below that which would cause denaturation and loss of enzyme activity, supercooling the resultant melt and immediately casting into a dispensing container and cooling to form a solid stick within the dispensing container.

In the process of manufacturing the product, any combination of components A, B, and C as hereinabove described and defined may be premixed with the enzyme D after the mixture has been heated and uniformly blended at a temperature below any temperature injurious to the enzyme. The premix is introduced to what may be referred to as a supply chamber in which the blend with dispersed enzyme is maintained at a temperature sufficient to assure pumpable fluidity of the mixture, e.g., about 140° F, by indirect heat transfer as by circulating hot water through a closed coil or a jacket about the chamber. The mixture is continuously stirred or agitated to maintain consistency of the composition.

From the supply chamber the mixture is pumped through cooling zone in the form of a coil immersed in lower temperature water to cool the pumped stream to a reduced temperature, e.g., of about 116° F but which is variable in accordance with permissible changes in the composition of the product. From the cooling coil the mixture passes under pump pressure through a recirculating filling head, e.g., of the piston type, from which the cooled mixture is delivered into tubes which, for the purposes of forming pre-spotter sticks, may be open top cylinders being advanced in single file on a conveyor. As the filled tubes advance beyond the filling head, they are cooled by circulation of ambient or refrigerated air blown from a fan. When the top of each stick content has solidified, the tube may be capped and allowed to cool for an additional period until the mixture is solidified throughout.

From the dispensing head the residual mixture is recirculated to the supply chamber through a heating zone in the form of an externally heated coil which elevates the temperature of the mixture to that maintained in the supply chamber.

The process may be further detailed in reference to the specific composition of Example 9 given above. The mixture is prepared in the described manner by heating and agitating the mixture at a temperature of 150° ± 10° F. Following uniform dispersion of the enzyme in the mixture, the latter is transferred to and held in the supply chamber at a temperature of about 140°–150° F. The molten mixture is pumped through the cooling zone coil and cooled to a temperature of 114° ± 1° F. Immediately after the cooled mixture exits the cooling stage, it passes through the dispensing head into the ultimate dispensing containers. The filled containers are air cooled to a temperature of 80° ± 10° F. For cylindrical containers of about 2.5 oz. contents and about 3½ inches height and 1½ inches diameter a cooling period of around 15 minutes in 80° F air is adequate.

We claim:

1. For rub-on application to stains and soil deposits on fabrics preparatory to laundering, the solid product consisting essentially of water soluble nonionic detergent and stable laundry enzyme uniformly dispersed therein, said product being characterized as having ASTM Penetrometer hardness between about 4.5 mm and 10.5 mm measured using a standard needle with 50 gram load.

2. The product of claim 1 which is essentially anhydrous and soap-free.

3. The product of claim 1 in cylindrical stick form.

4. The product of claim 1 having a melting point between about 125° and 140° F.

5. The product of claim 4 in which said nonionic detergent includes a blend of normally solid and normally liquid nonionic detergents.

6. The product of claim 5 in which the melting temperature ranges of said normally solid and liquid detergents are respectively about 80° to 165° F, and −40° to 80° F.

7. The product of claim 5 in which said blend includes a higher melting temperature normally solid hardening wax having a melting temperature of about 100° to 200° F.

8. The product of claim 7 in which the weight percentages of said detergents and enzyme in said product are:

normally solid detergent 10 to 60%
normally liquid detergent 10 to 75%
wax 5 to 40%
enzyme 0.01 to 10%

9. The product of claim 7 in which said product is essentially anhydrous and soap-free and has ASTM Penetrometer hardness between about 4.5 and 10.5 mm as measured using a standard needle with 50 gram load.

10. The product of claim 8 in which said product is essentially anhydrous and soap-free and has ASTM Penetrometer hardness between about 4.5 and 10.5 mm as measured using a standard needle with 50 gram load.

11. The process of manufacturing the product defined in claim 1 that includes heating the product mixture composition for conversion to fluid state, pumping the heated mixture through a cooling zone from which the mixture passes to a filling head, dispensing the mixture from said head into containers wherein the mixture is further cooled and solidified and recirculating residual fluid from the dispensing head through a heating zone and returning the heated mixture to the supply chamber.

12. The process of claim 11 in which the mixture contains a relatively high temperature melting wax, a nonionic detergent normally in solid form, and a normally liquid nonionic component and wherein the temperature of the circulated mixture is maintained above the solidification temperature of the wax.

13. The process of claim 12 in which the melting temperature ranges of the normally solid and liquid detergents and the wax component are respectively 80° to 165° F, and −40° to 80° F, and 100° to 200° F.

14. For rub-on application to stains and soil deposits on fabrics preparatory to laundering, the solid product consisting essentially of water soluble non-ionic detergents characterized as having ASTM Penetrometer hardness between 4.5 mm and 10.5 mm measured using a standard needle with 50 gram load, and having a melting point between about 125° and 140° F.

15. The product of claim 14 which is essentially anhydrous and soap-free.

16. The product of claim 14 in cylindrical stick form.

17. The product of claim 14 in which said product contains wax and liquid non-ionics serving to plasticize the product.

* * * * *